US008166606B2

(12) United States Patent
Johnson et al.

(10) Patent No.: US 8,166,606 B2
(45) Date of Patent: May 1, 2012

(54) SQUEEGEE ASSEMBLY

(75) Inventors: Kale R. Johnson, Minneapolis, MN (US); Everett Eugene Johnson, St. Bonifacius, MN (US)

(73) Assignee: Nilfisk-Advance, Inc., Plymouth, MN (US)

( * ) Notice: Subject to any disclaimer, the term of this patent is extended or adjusted under 35 U.S.C. 154(b) by 395 days.

(21) Appl. No.: 12/295,383

(22) PCT Filed: Feb. 6, 2007

(86) PCT No.: PCT/US2007/002919

§ 371 (c)(1),
(2), (4) Date: Sep. 30, 2008

(87) PCT Pub. No.: WO2007/092322

PCT Pub. Date: Aug. 16, 2007

(65) Prior Publication Data

US 2009/0113666 A1 May 7, 2009

(51) Int. Cl.

| | |
|---|---|
| ***A47L 1/00*** | (2006.01) |
| ***A47L 1/06*** | (2006.01) |
| ***A47L 5/00*** | (2006.01) |
| ***A47L 23/04*** | (2006.01) |
| ***B60S 1/02*** | (2006.01) |

(52) U.S. Cl. ..... 15/250.452; 15/250.48; 15/245; 15/401; 15/117; 15/121

(58) Field of Classification Search ..... 15/401, 15/340.1–340.3, 117, 121, 245, 250.48, 250.452
See application file for complete search history.

(56) References Cited

U.S. PATENT DOCUMENTS

| | | | | | |
|---|---|---|---|---|---|
| 2,261,475 | A | * | 11/1941 | Kautenberg | 15/245 |
| 2,930,055 | A | * | 3/1960 | Fallen et al. | 15/4 |
| 3,496,591 | A | * | 2/1970 | Sheler | 15/320 |
| 4,007,516 | A | * | 2/1977 | Coules | 411/349 |
| 4,037,289 | A | | 7/1977 | Dojan | |
| 4,293,971 | A | | 10/1981 | Block | |
| 4,363,152 | A | | 12/1982 | Karpanty | |
| 4,429,433 | A | | 2/1984 | Burgoon | |
| 5,265,300 | A | * | 11/1993 | O'Hara et al. | 15/49.1 |
| 5,377,382 | A | * | 1/1995 | Bores et al. | 15/340.1 |
| 5,454,138 | A | * | 10/1995 | Mondigo et al. | 15/354 |
| 5,555,596 | A | | 9/1996 | Knowlton et al. | |
| 5,579,555 | A | * | 12/1996 | Pearse | 15/320 |
| 5,608,947 | A | | 3/1997 | Knowlton et al. | |

(Continued)

FOREIGN PATENT DOCUMENTS

JP 11-351220 12/1999

(Continued)

*Primary Examiner* — Bryan R Muller
(74) *Attorney, Agent, or Firm* — Alan Kamrath; Kamrath IP Lawfirm, PA

(57) ABSTRACT

A squeegee assembly (10, 10') includes a flexible wiper blade (30) sandwiched between a mounting bracket (32, 32') and a retaining strap (34, 34'). A retainer (94) has a head (98) which is positionable between aligned and misaligned positions with mounting apertures (82, 92) to allow disassembly, assembly and retention of the squeegee assembly (10, 10'). Arcuate portions (36, 36', 66, 66') formed in the mounting bracket (32, 32') and the retaining straps (34, 34') have different radiuses. Linear portions (68, 68', 70, 70') of the retaining straps (34, 34') have upper and lower edges (72, 74) bent from center portions thereof. The mounting brackets (32, 32') include L-shaped slots (46) for slideably receiving vertical bolts (56) of the floor maintenance machine (12).

14 Claims, 11 Drawing Sheets

U.S. PATENT DOCUMENTS

| | | | | |
|---|---|---|---|---|
| 5,611,108 | A | 3/1997 | Knowlton et al. | |
| 5,628,086 | A | 5/1997 | Knowlton et al. | |
| 5,630,246 | A * | 5/1997 | Knowlton et al. | 15/340.4 |
| 6,073,304 | A | 6/2000 | Knowlton et al. | |
| 6,088,873 | A | 7/2000 | Pacchini et al. | |
| 6,397,429 | B1 | 6/2002 | Legatt et al. | |
| 6,519,808 | B2 * | 2/2003 | Legatt et al. | 15/401 |
| 6,557,207 | B2 | 5/2003 | Stuchlik | |
| 6,602,018 | B2 | 8/2003 | Feeny et al. | |
| 6,895,633 | B2 | 5/2005 | Tucker | |
| 7,296,522 | B1 * | 11/2007 | Mahmalji | 108/50.13 |
| 2005/0193519 | A1 | 9/2005 | Joynt | |
| 2007/0289086 | A1 * | 12/2007 | Davis et al. | 15/340.3 |

FOREIGN PATENT DOCUMENTS

| | | | |
|---|---|---|---|
| WO | WO 2005/107561 | A2 | 11/2005 |

* cited by examiner

SQUEEGEE ASSEMBLY

BACKGROUND

The present invention generally relates to squeegee assemblies for collecting and directing solution on surfaces and in preferred aspects on floors and particularly to the installation and removal of such squeegee assemblies and/or of the flexible wiper blades from such squeegee assemblies.

In floor maintenance machines, a common method for containing and directing cleaning solution is the use of flexible wiper blades. Due to their continuous contact with the floor during machine operation, flexible wiper blades wear and require repositioning and/or replacing to apply an unworn edge against the floor. Conventionally, such flexible wiper blades are held in place utilizing multiple (often in the order of 8 or 9) bolts to clamp the wiper blade in place and requiring the use of two wrenches or other tools to remove them. As the bolts are in close proximity to the cleaning solution in operation, they often become rusted or frozen, further complicating repositioning or replacing. Thus, the process of repositioning or replacing wiper blades can be time consuming and sometimes frustrating.

Further, to reposition or replace the wiper blade, it is typically required to remove the squeegee assembly from the machine. However, the squeegee assembly can be improperly installed on the machine and can dislodge from the machine. Likewise, the squeegee assembly in its normal operation is subject to being jarred and vibrated resulting in dislodgment from the machine due to its engagement with the floor, its abutment with obstacles adjacent to the floor and its attachment to the machine. Such dislodgement interrupts normal operation, requires time to reinstall, and can result in damage to the squeegee assembly and/or machine and/or to the surroundings.

Thus, a need exists for a novel squeegee assembly which overcomes the shortcomings and deficiencies of the prior art and which is otherwise advantageous.

SUMMARY

The present invention solves this need and other problems in the field of collecting and directing solution from surfaces by providing, in preferred aspects, a novel squeegee assembly including a retainer having a shaft extending from a first retaining element, passing through aligned mounting apertures formed in a flexible wiper blade and a second retaining element, and terminating in a head. The head and the mounting apertures have cross sections having different radial spacings from the shaft. The head is positionable between a first position aligned with the mounting apertures to allow passage of the head therethrough and a second position misaligned with the aligned mounting apertures to thereby sandwich the flexible wiper blade between the first and second retaining elements.

In other aspects of the present invention, a squeegee assembly includes a flexible wiper blade sandwiched between first and second retaining elements, with the second retaining element having upper and lower bent edges defining an abutment plane abutting with the flexible wiper blade and spaced from a center section. The center section of the second retaining element is removably drawn toward the flexible wiper blade when sandwiched between the first and second retaining elements.

In further aspects of the present invention, a squeegee assembly includes first and second retaining elements each having an arcuate portion located intermediate leading and trailing ends but having different radiuses. A flexible wiper blade is sandwiched between the first and second retaining elements and the arcuate portions thereof and which are removably drawn together.

In still other aspects of the present invention, the mounting bracket of a squeegee assembly to which a flexible wiper blade is removably secured includes first and second, L-shaped slots for slideably receiving vertical bolts of a machine. Thus, the mounting bracket must be moved in a first direction to receive the bolts in a first leg of the L-shaped slots and then perpendicularly to receive the bolts in a second leg of the L-shaped slot.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
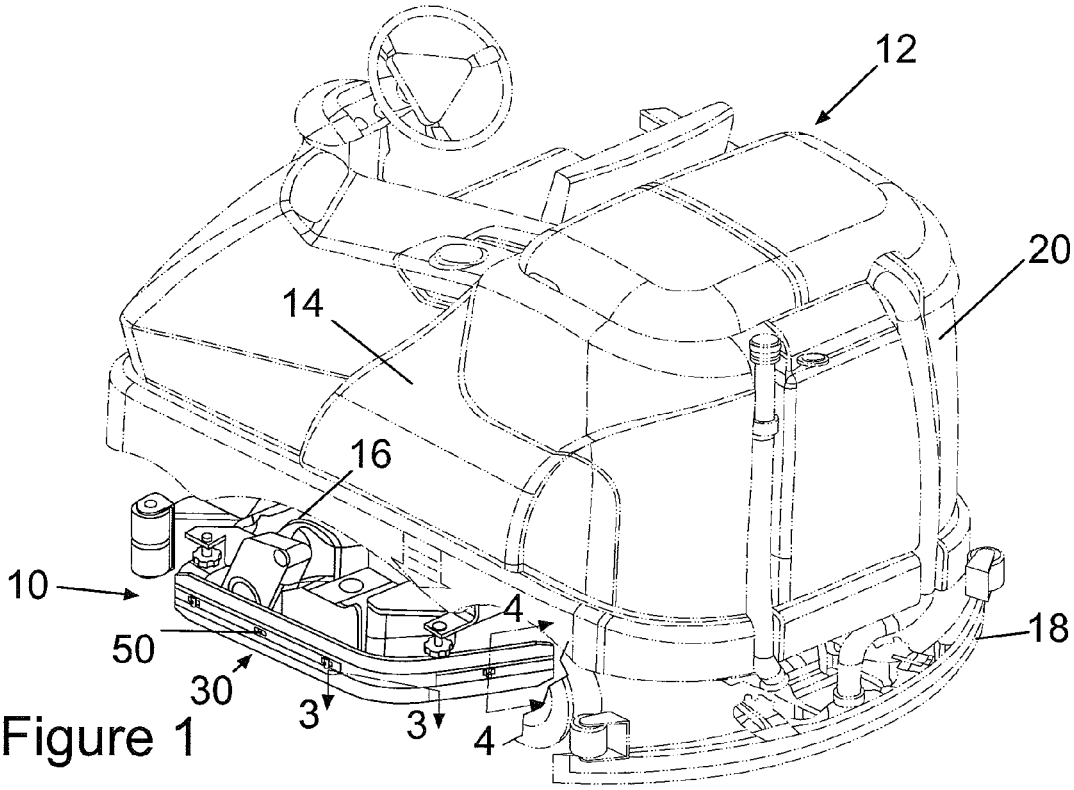
FIG. 1 shows a perspective view of a squeegee assembly mounted upon a floor maintenance machine according to the preferred teachings of the present invention, with portions of the floor maintenance machine being shown in phantom.

All figures are drawn for ease of explanation of the basic teachings of the present invention only; the extensions of the figures with respect to number, position, relationship, and dimensions of the parts to form the preferred embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "width", "length", "size", "end", "side", "horizontal", "vertical", "axial", "trailing", "leading", and similar terms are used herein, it should be understood that these terms have reference only to the structure shown in the drawings as it would appear to a person viewing the drawings and are utilized only to facilitate describing the illustrative embodiments.

DESCRIPTION OF ILLUSTRATIVE EMBODIMENTS

Squeegee assemblies according to the preferred teachings of the present invention are shown in the most preferred form in connection with floor maintenance machines 12 and generally designated 10 and 10'. Floor maintenance machine 12 generally includes a clean solution tank 14 for holding cleaning solution to be dispensed to the floor in a controlled manner, an agitating element 16 or 16' for agitating the cleaning solution upon the floor, and a vacuum squeegee assembly 18 for collecting dirty solution from the floor and directing it under vacuum to a dirty solution tank 20. Although applicable to vacuum squeegee assembly 18, squeegee assemblies 10 and 10' according to the preferred teachings of the present invention are shown and described as being of the skirt or wiper type for purposes of maintaining solution within the width of machine 12 and directing it towards vacuum squeegee assembly 18 as floor maintenance machine 12 moves in its operating direction. Although floor maintenance machines 12 shown are of the ride-on type, it can be appreciated that floor maintenance machine 12 can be a walk-behind type. Likewise, floor maintenance machine 12 can be externally powered or can be internally powered such as by a battery pack or an onboard engine and can be propelled in any desired manner such as being pushed or pulled by a power unit or even the operator or as including its own propulsion.

In a first preferred form shown, agitating element 16 is of the cylindrical brush type including one or more cylindrical brushes each rotatable about an axis spaced from and parallel to the floor. In a second preferred form shown, agitating element 16' is of the disc type including one or more disk type agitating elements each of which are rotatable about an axis perpendicular to the floor. However, it should be appreciated that squeegee assembly 10 or 10' according to the teachings of the present invention can be utilized in other types and forms of floor maintenance machines 12 and in other types and forms of machines where it is desired to direct solution along a surface utilizing a flexible wiper blades 30.

In the preferred form shown, squeegee assembly 10 according to the preferred teachings of the present invention generally includes first and second retaining elements shown in the preferred forms as a mounting bracket 32 and a metal retaining strap 34 between which wiper blade 30 is sandwiched. In particular, mounting bracket 32 includes a first arcuate portion 36 having an inner concave surface. A first linearly straight portion 38 extends from a leading end of bracket 32 to a forward end of portion 36, and a second linearly straight portion 40 extends from a trailing end of bracket 32 to the rearward end of portion 36. Mounting tabs 42 and 44 extend generally perpendicularly from the upper edges of portions 38 and 40, with tab 42 extending inwardly of bracket 32 whereas tab 44 extends outwardly of bracket 32. Each of tabs 42 and 44 includes a L-shaped slot 46 having a first leg **46*a* extending from the outer edge of the respective tab 42 and 44 and a second leg 46*b* extending generally perpendicularly to first leg 46*a*. A protrusion 46*c* extends into leg 46*b* of L-shaped slots 46 at the inner interconnection of legs 46*a* and 46*b*. In the preferred form shown, slots 46 extend in opposite directions in tabs 42 and 44, with leg 46*a* extending outward in tab 42 and leg 46*b* extending forward in tab 42 whereas leg 46*a* extends forward and leg 46*b* extends inward in tab 44**.

In the most preferred form, the lower edge of the initial part of portion 38 includes an outward flange 48. Other than flange 48, portions 36, 38 and 40 are generally linearly straight between the upper and lower edges. According to the preferred teachings of the present invention, bracket 32 includes multiple locating pins 50 extending outwardly therefrom. In the preferred form shown, each of portions 36, 38 and 40 includes a locating pin 50. According to the preferred teachings of the present invention, bracket 32 further includes multiple mounting bores 52, with portion 38 shown as including two bores 52 and portion 40 including a single bore 52.

In the preferred form shown, machine 12 includes first and second ears 54 from which first and second vertical bolts 56 extend. Threadably received on each bolt 56 are an adjustment knob 58 and an adjustable stop 60. Bolts 56 are received in slots 46, with tabs 42 and 44 located intermediate knob 58 and stop 60. It should be appreciated that by adjustment of stop 60, the height of bracket 32 relative to the floor can be adjusted. By threading knob 58, tabs 42 and 44 can be sandwiched between knob 58 and stop 60.

Strap 34 according to the preferred teachings of the present invention includes a first arcuate portion 66 having an inner concave surface. In the most preferred form, portion 36 has a radius slightly smaller than portion 66 and in the preferred form of 5% difference or less. A first linearly straight portion 68 extends from a leading end of strap 34 to a forward end of portion 68, and a second linearly straight portion 70 extends from a trailing end of strap 34 to a rearward end of portion 68.

In the most preferred form, the lower edge of the initial part of portion 68 includes an outward flange 78 corresponding to flange 48 of bracket 32. According to the preferred teachings of the present invention, portions 68 and 70 each includes a bent upper edge 72 which in the preferred form has a linear configuration extending at an obtuse angle from the center section of portions 68 and 70 which also is of a linear configuration. Aside from flange 78, portions 68 and 70 each includes a bent lower edge 74 which in the preferred form has a linear configuration extending at an obtuse angle from the center section of portions 68 and 70. In the most preferred form, the obtuse angles at which edges 72 and 74 extend from the center section are equal. Thus, edges 72 and 74 define an abutment plane with the center section of bracket 32 being spaced therefrom and from wiper blade 30 when sandwich between bracket 32 and strap 34.

Strap 34 according to the preferred teachings of the present invention further includes locating apertures 80 extending therethrough at the center section and at locations corresponding to and for receipt of locating pins 50. All or some of apertures 80 can be horizontally elongated. Strap 34 according to the preferred teachings of the present invention further includes horizontally elongated mounting apertures 82 extending therethrough at the center section and at locations corresponding to mounting bores 52. In the most preferred form, apertures 82 have cross sections of rectangular shapes.

Wiper blade 30 is formed of flexible material such as rubber and/or plastic and which requires external support by bracket 32 and strap 34. Wiper blade 30 according to the preferred teachings of the present invention includes locating apertures 90 extending therethrough at locations corresponding to and for receipt of locating pins 50. In the preferred form shown, apertures 90 have circular cross sections corresponding to pins 50. Wiper blade 30 according to the preferred teachings of the present invention further includes horizontally elongated mounting apertures 92 extending therethrough at locations corresponding to mounting bores 50 and apertures 82. In the most preferred form, apertures 92 have cross sections of rectangular shapes of a size and shape corresponding to apertures 82.

Squeegee assembly 10 according to the preferred teachings of the present invention includes a retainer 94. In the most preferred form, retainer 94 generally includes a threaded shaft 96, a head 98 and a hand operable thumb nut 100. In the preferred form, head 98 has cross sections perpendicular to the axis of shaft 96 larger than and different from the cross sections of shaft 96 perpendicular to the axis of shaft 96 and having different radial spacings from and different radial extents than the cross sections of shaft 96, and in the most preferred form having generally rectangular cross sections. In the most preferred form, head 98 is generally semi-cylindrical in shape with shaft 96 extending perpendicularly from the axially extending flat surface thereof In the most preferred form, head 98 is threaded on shaft 96 during manufacture but is suitably secured thereto to prevent relative rotation after manufacture. Shaft 96 is rotatably received in bracket 32 and in the preferred form threadedly received in thumb nut 100. Nut 100 is generally T-shaped in the preferred form shown. In the most preferred form, mounting apertures 82 and 92 of strap 34 and wiper blade 30 have a shape and size corresponding to the axially extending flat surface representing the largest cross section of head 98 perpendicular to shaft 96.

In the preferred form shown, squeegee assembly 10' according to the preferred teachings of the present invention generally includes a mounting bracket 32' and a metal retaining strap 34' between which wiper blade 30 is sandwiched. In particular, mounting bracket 32' includes a first arcuate portion 36' having an inner concave surface. A first linearly straight portion 38' extends from a leading end of bracket 32' to a forward end of portion 36', and a second linearly straight portion 40' extends from a trailing end of bracket 32' to the rearward end of portion 36'. A mounting flange 43 extends generally perpendicularly from the upper edges of portions 36', 38' and 40', with flange 43 extending inwardly of bracket 32'. Flange 43 includes first and second L-shaped slots 46 extending in the same direction in flange 43, with leg **46*a* extending outward in flange 43 and leg 46*b* extending forward in flange 43. One of slots 46 is located intermediate of portion 36', while the other of slots 46 is located intermediate of portion 38'**.

In the most preferred form, the lower edge of the initial part of portion 38' includes an outward flange 48'. Other than flange 48', portions 36', 38' and 40' are generally linearly straight between the upper and lower edges. According to the preferred teachings of the present invention, bracket 32' includes multiple locating pins 50 extending inwardly therefrom. In the preferred form shown, each of portions 36, 38 and 40 includes a locating pin 50. According to the preferred teachings of the present invention, bracket 32' further includes multiple horizontally elongated mounting apertures 82 extending therethrough, with each of portions 38' and 40' including a single mounting aperture 82.

Flange 43 is located intermediate knob 58 and stop 60. It should be appreciated that by adjustment of stop 60, the height of bracket 32' relative to the floor can be adjusted. By threading knob 58, flange 43 can be sandwiched between knob 58 and stop 60.

Strap 34' according to the preferred teachings of the present invention includes a first arcuate portion 66' having an inner concave surface. In the most preferred form, portion 66' has a radius slightly smaller than portion 36' and in the preferred form of a 5% difference or less. A first linearly straight portion 68' extends from a leading end of strap 34' to a forward end of portion 68', and a second linearly straight portion 70' extends from a trailing end of strap 34' to a rearward end of portion 68'.

In the most preferred form, the lower edge of the initial part of portion 68' includes an outward flange 78' corresponding to flange 48' of bracket 32'. According to the preferred teachings of the present invention, portions 68' and 70' each includes a bent upper edge 72 which in the preferred form has a linear configuration extending at an obtuse angle from the center section of portions 68' and 70' which also is of a linear configuration. Aside from flange 78', portion 68' and 70' each includes a bent lower edge 74 which in the preferred form has a linear configuration extending at an obtuse angle from the center section of portions 68' and 70'. In the most preferred form, the obtuse angles at which edges 72 and 74 extend from the center section are equal.

Strap 34' according to the preferred teachings of the present invention further includes locating apertures 80 extending therethrough at locations corresponding to and for receipt of locating pins 50. All or some of apertures 80 can be horizontally elongated. Strap 34' according to the preferred teachings of the present invention further includes multiple mounting bores 52, with each of portions 38' and 40' shown as including a single bore 52.

Figure 2:
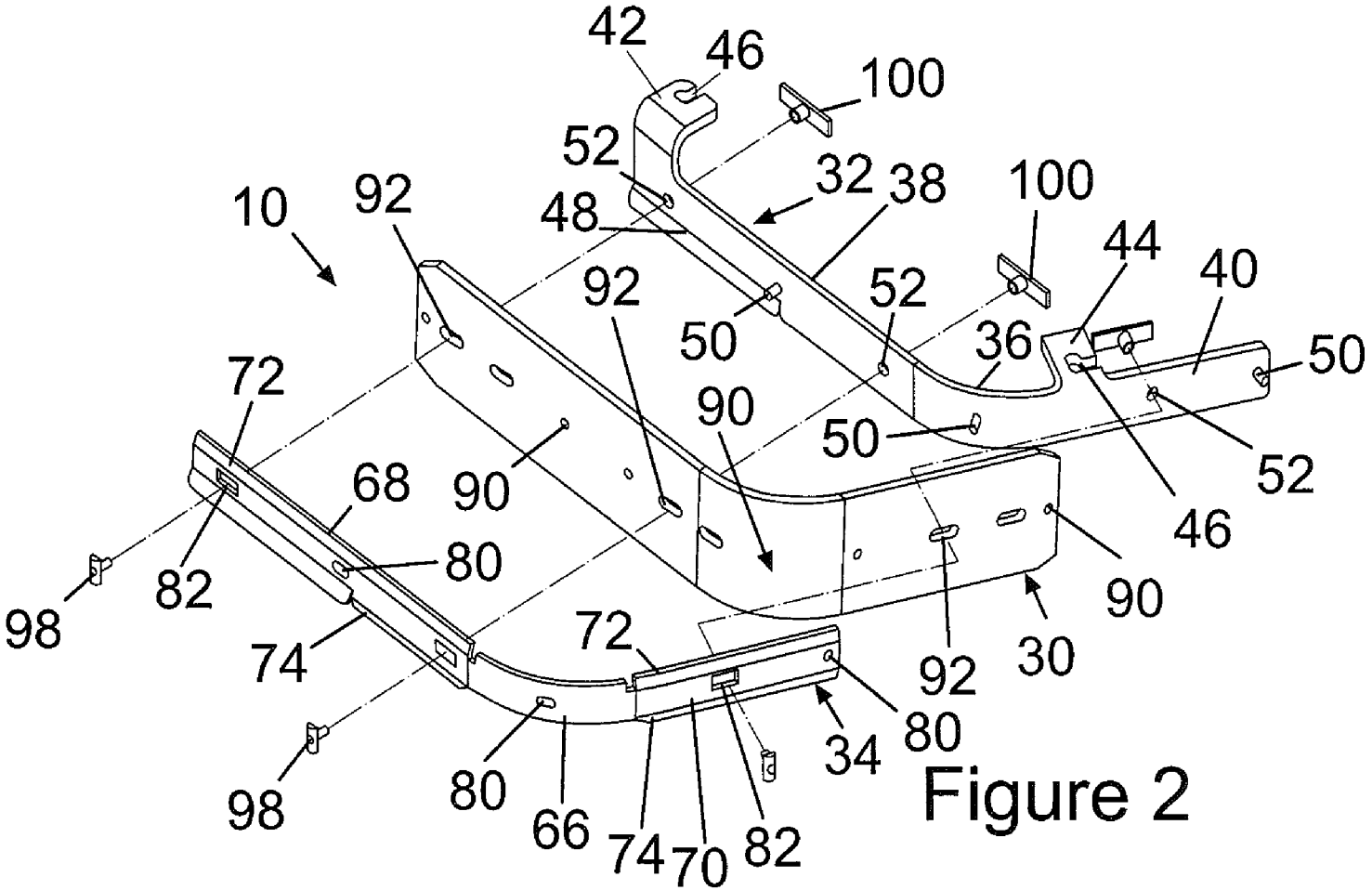
FIG. 2 shows an exploded, perspective view of the squeegee assembly of FIG. 1.
Figure 3:
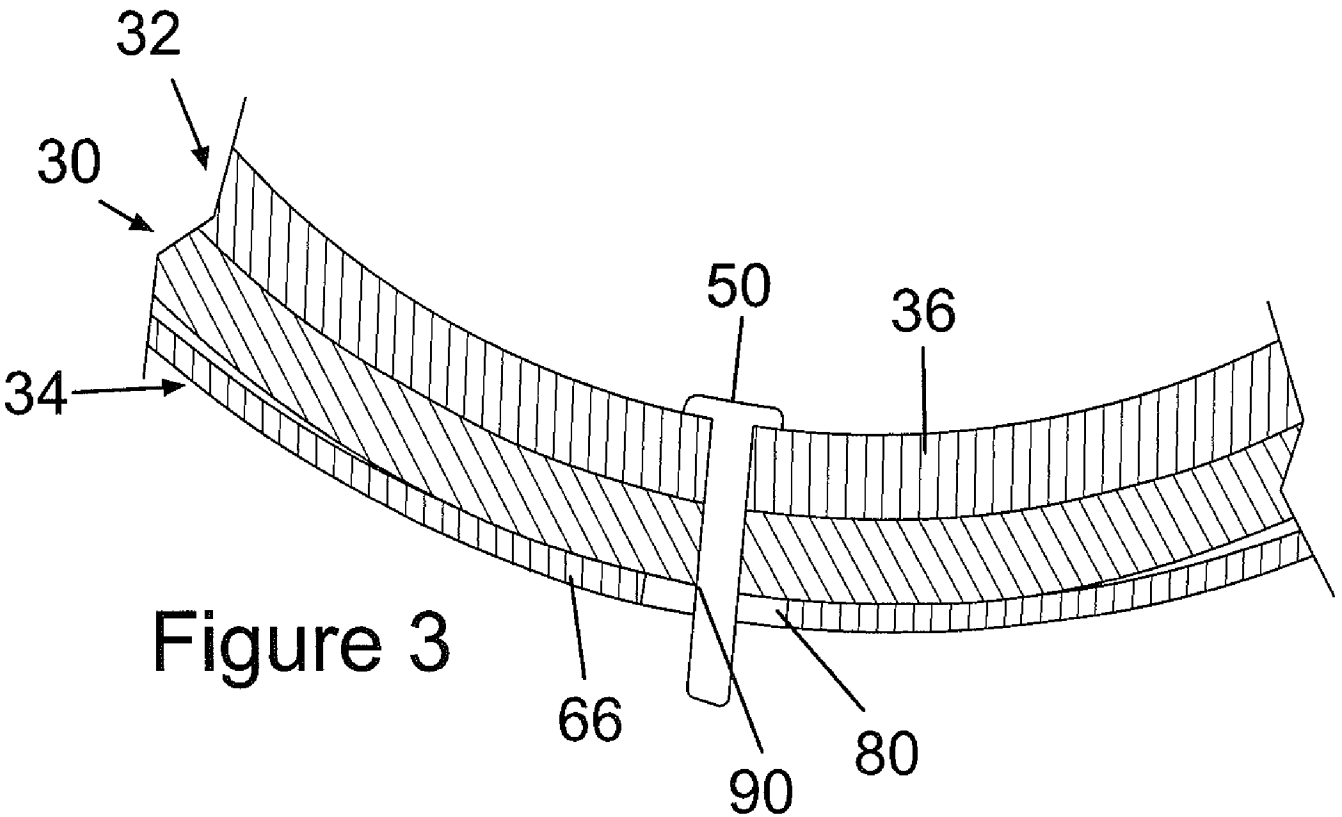
FIG. 3 shows a partial, cross-sectional view of the squeegee assembly of FIG. 1 according to section line 3-3 of FIG. 1.
Figure 4:
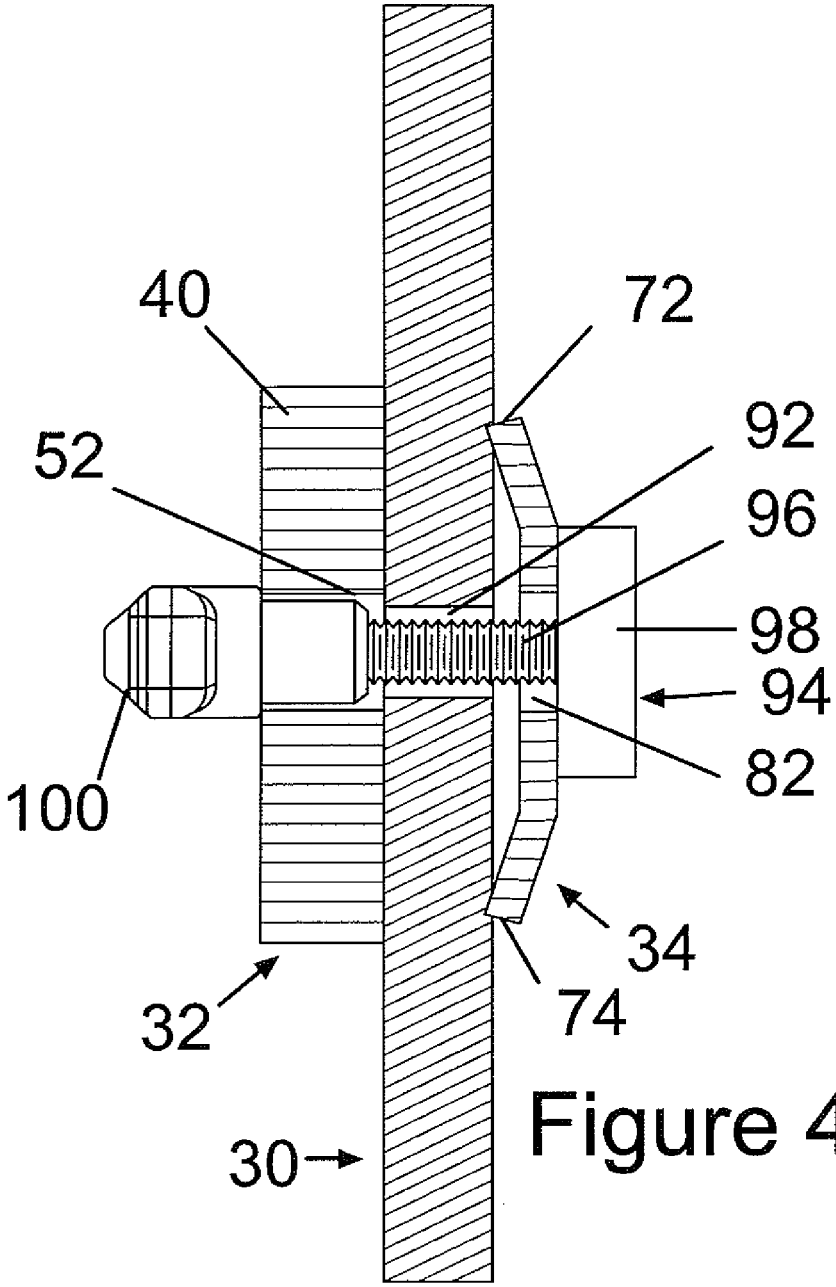
FIG. 4 shows a cross-sectional view of the squeegee assembly of FIG. 1 according to section line 4-4 of FIG. 1.
Figure 5:
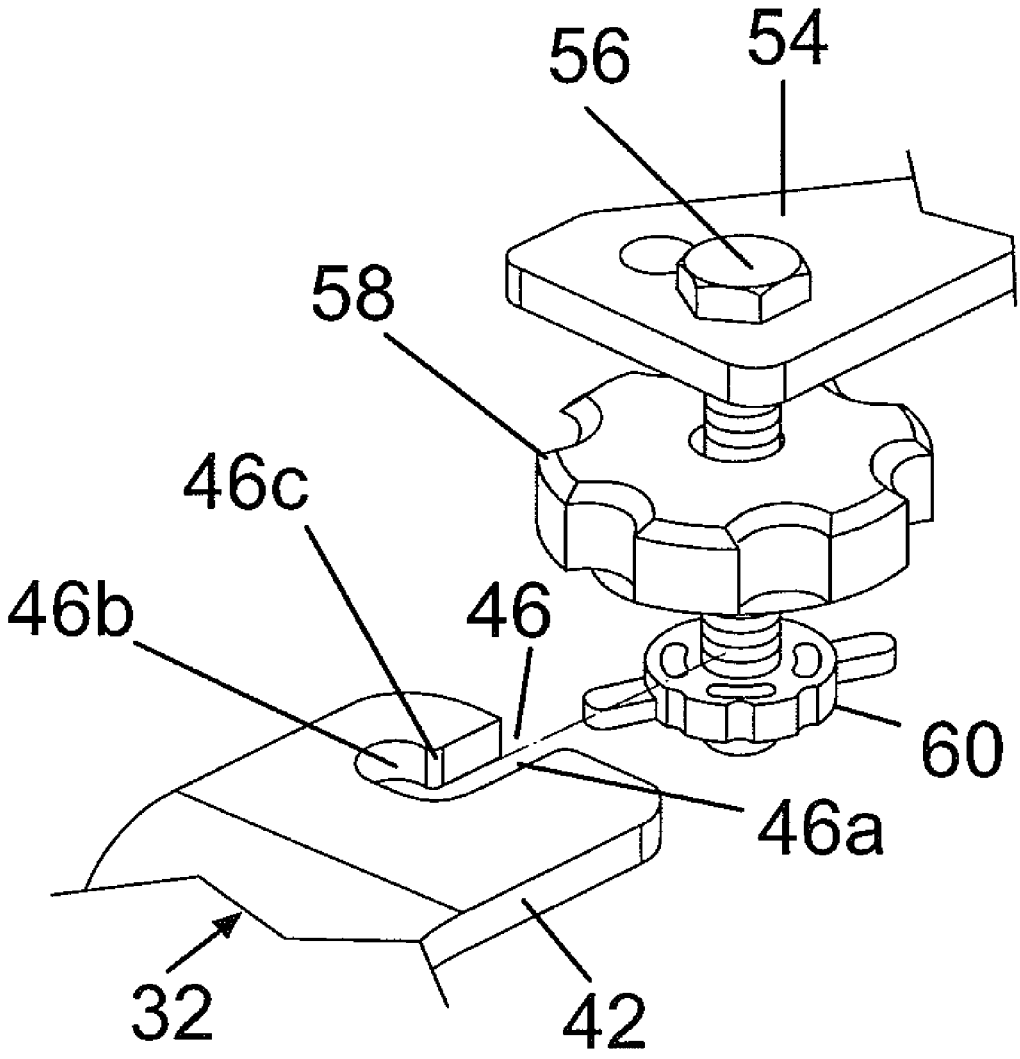
FIG. 5 shows a partial, exploded, perspective view of the mounting of the squeegee assembly of FIG. 1.
Figure 6:
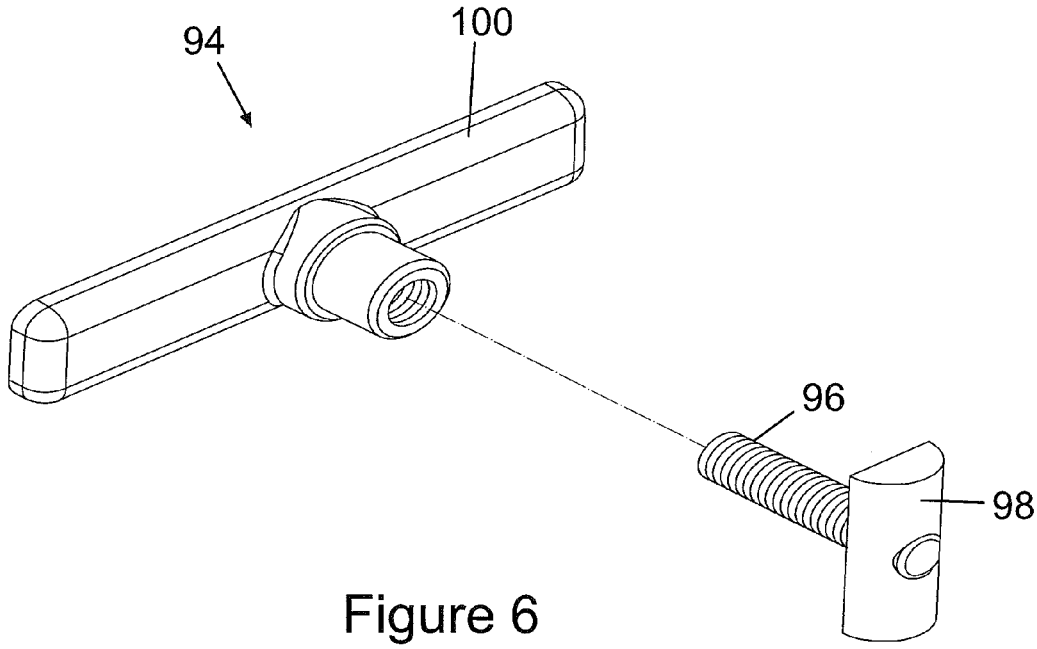
FIG. 6 shows an exploded, perspective view of the retainer of the squeegee assembly of FIG. 1.
Figure 7:
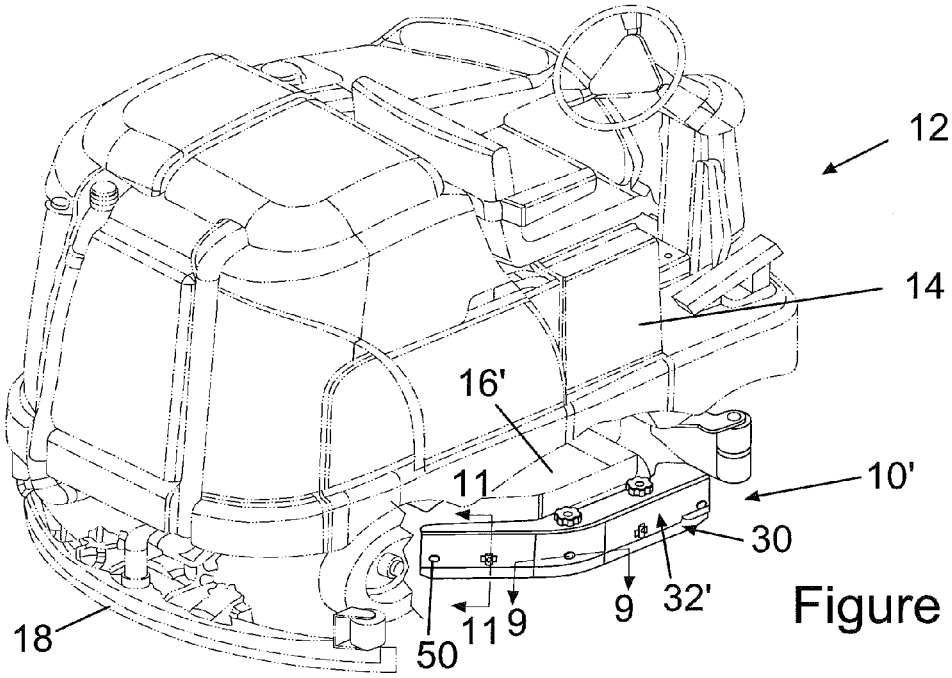
FIG. 7 shows a perspective view of a further embodiment of a squeegee assembly mounted upon a floor maintenance machine according to the preferred teachings of the present invention, with portions of the floor maintenance machine being shown in phantom.
Figure 8:
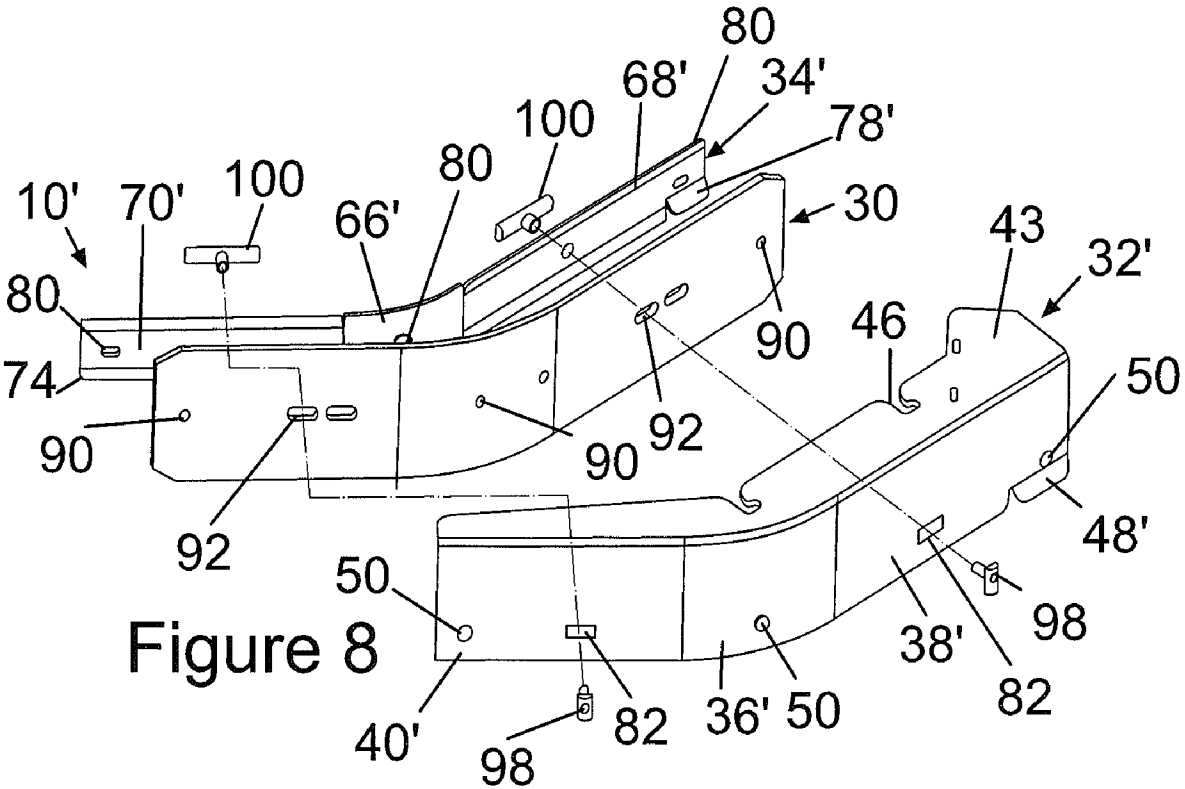
FIG. 8 shows an exploded, perspective view of the squeegee assembly of FIG. 7.
Figure 9:
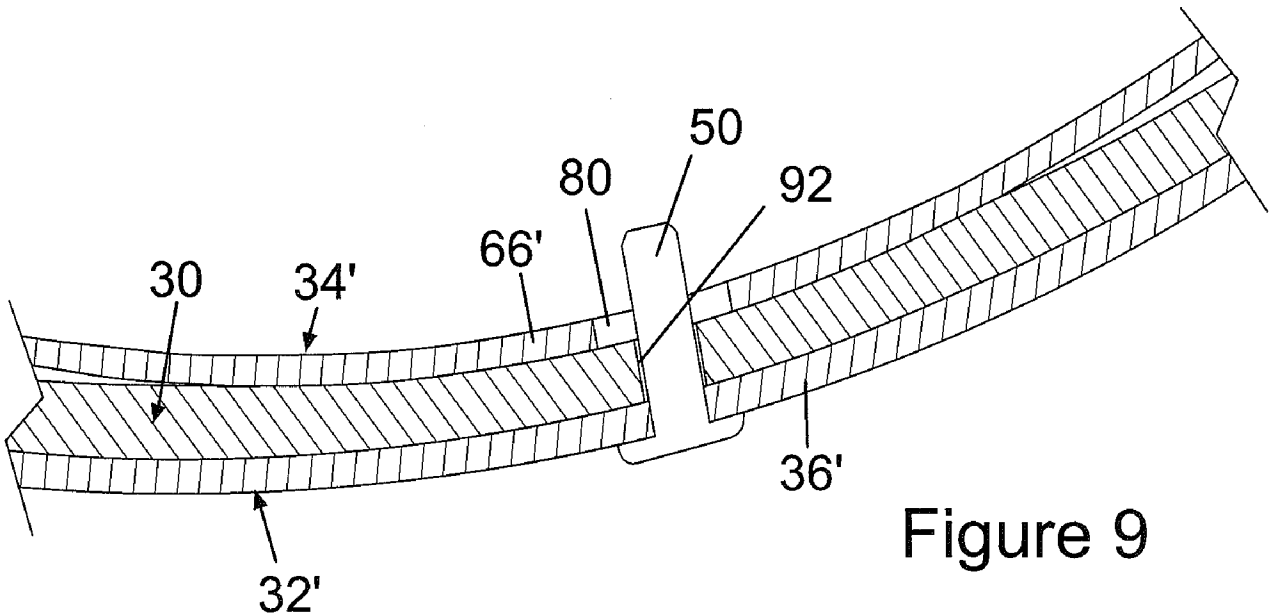
FIG. 9 shows a partial, cross-sectional view of the squeegee assembly of FIG. 7 according to section line 9-9 of FIG. 7.
Figure 10:
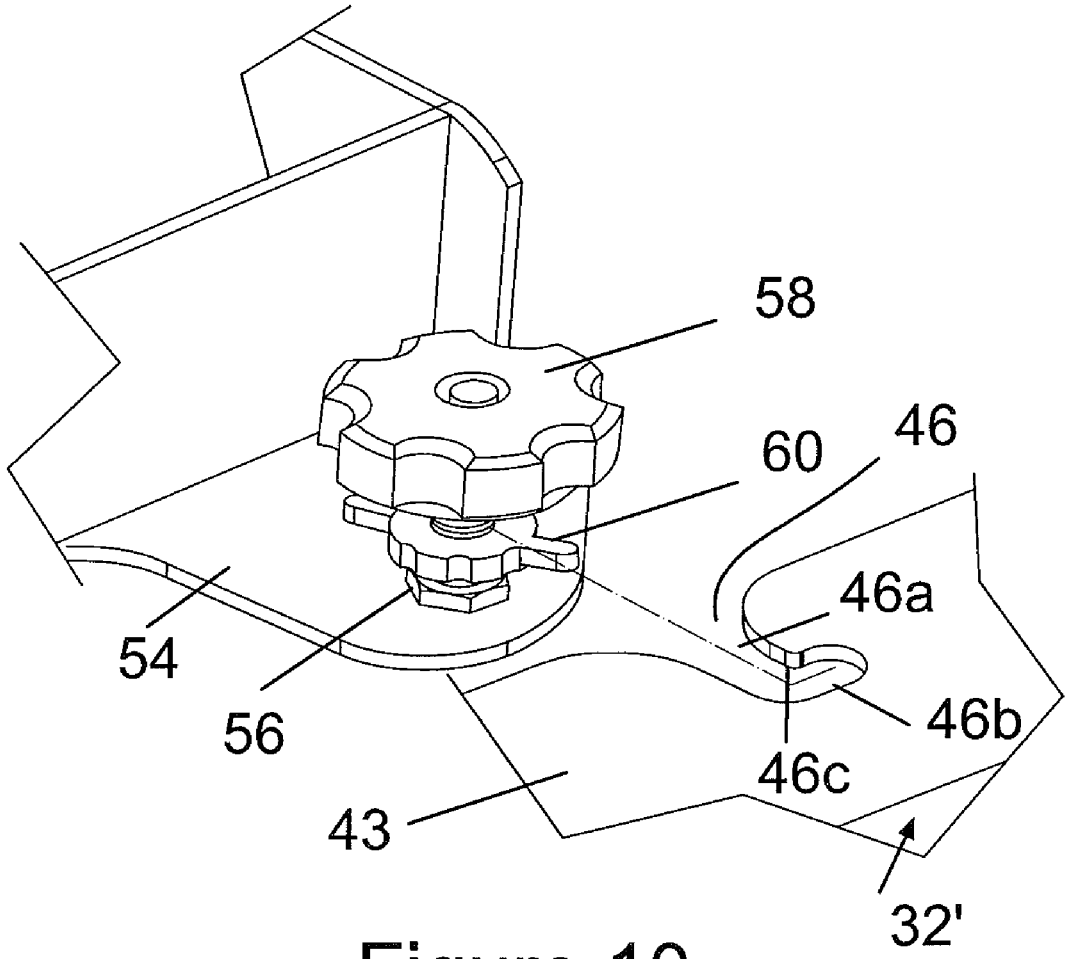
FIG. 10 shows a cross-sectional view of the squeegee assembly of FIG. 7 according to section line 10-10 of FIG. 7.
Figure 11:
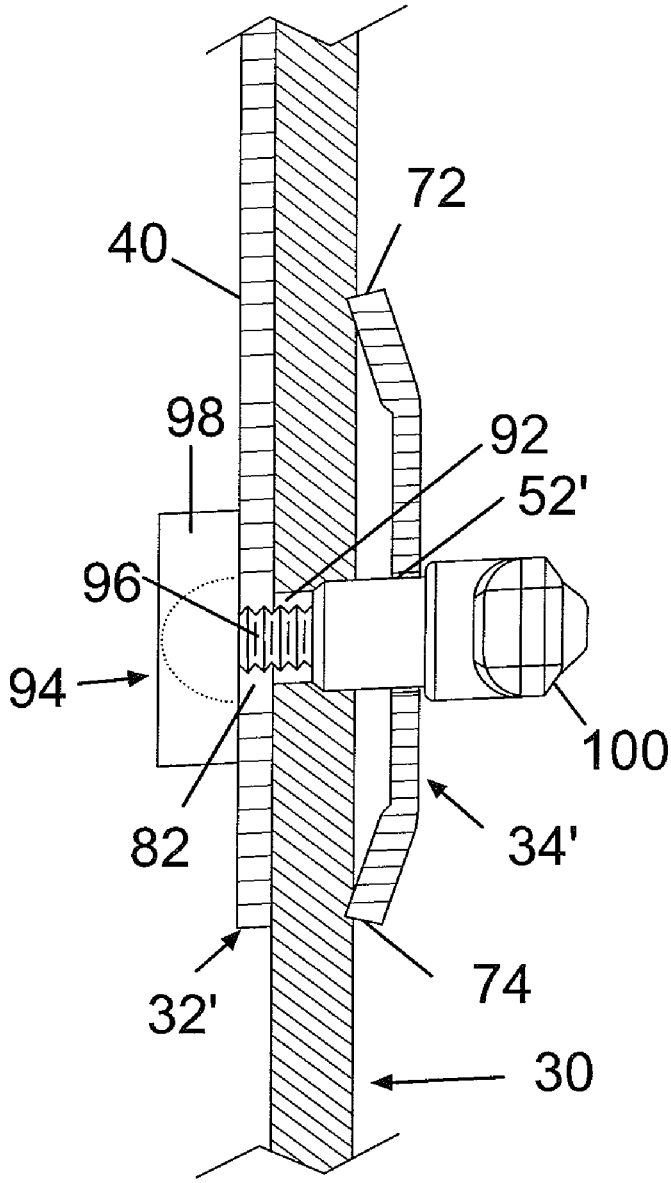
FIG. 11 shows a partial, exploded, perspective view of the mounting of the squeegee assembly of FIG. 7.

Now that the basic construction of squeegee assemblies 10 and 10' have been set forth according to the preferred teachings of the present invention, an operation and some of the advantages which can be obtained thereby can be explained. For purposes of explanation, it will be assumed that assembly 10 or 10' has been removed from machine 12 and disassembled. Further, it will be assumed that heads 98 of retainers 94 are in their first position which in the preferred form shown is generally parallel to the floor when squeegee assembly 10 or 10' is installed on machine 12. Initially, flexible wiper blade 30 is positioned on bracket 32 or 32' by sliding locating apertures 90 onto locating pins 50 and mounting apertures 92 onto retainer 94. It should be appreciated that wiper blade 30 is located outwardly of bracket 32 in the embodiment of FIGS. 1-5 but is located inwardly of bracket 32' in the embodiment of FIGS. 7-11. Next, straps 34 or 34' is positioned relative to bracket 32 or 32' by sliding locating apertures 80 onto locating pins 50 and mounting apertures 82 onto retainer 94. It should be appreciated that mounting apertures 82 and 92 are aligned and have shape corresponding to and for slidable passage of head 98 in its first position. At that time, heads 98 of retainers 94 are moved into their second position which in the preferred form is by rotating shaft 96 relative to mounting bores 52. In the second position, heads 98 are misaligned with aligned mounting apertures 82 and 92 to prevent passage of head 98 tberethrough, with heads 98 in their second position being rotated 90° from the first position.

It should be appreciated that squeegee assembly 10 or 10' according to the teachings of the present invention can be assembled or disassembled without the use of tools by simply grasping nut 100 and/or head 98 by the hands and rotating heads 98 between their first and second positions. It should be appreciated that rotation of head 98 in the most preferred form can occur as a result of threading or unthreading shaft 96 relative to nut 100 and/or by rotation of shaft 96 relative to mounting bores 52. Thus, rusting and/or freezing of nut 100 on shaft 96 does not deter the ease of assembly or disassembly of squeegee 10 or 10' according to the teachings of the present invention.

It should be appreciated that the spacing between head 98 and nut 100 can be adjusted at the factory during manufacture of squeegee assembly 10 or 10' according to the teachings of the present invention by simply threading nut 100 on shaft 96 to place the shaft 96 under the desired tensional force when head 98 is in the second position. In this regard, the tensional force should be sufficient to sandwich flexible wiper blade 30 to prevent movement in operation while not being too large to allow rotation in the preferred form without the use of tools.

The preferred construction of straps 34 and 34' according to the teachings of the present invention is advantageous in reducing the number of and the amount of tension of retainers 94. Specifically, due to the C-shaped cross sections of portions 68, 68', 70 and 70' and due to their thickness allowing slight flexing under tension of retainers 94, bent edges 72 and 74 tend to dig into and grip wiper blade 30 as the center sections thereof are drawn toward bracket 32 or 32' under the tension of retainers 94. Likewise, the difference in the radiuses of portions 36, 36', 66 and 66' results in portions 38, 38', 40, 40', 68, 68', 70 and 70' extending at nonparallel angles to each other in a relaxed condition. Thus, when the leading ends and trailing ends are drawn together due to retainers 94, wiper blade 30 is compressed and clamped between sections 36, 36', 66 and 66' to prevent movement therebetween. Thus, the tension requirement needed by retainers 94 can be minimized according to the preferred teachings of the present invention. This is advantageous in allowing rotation of head 98 without the use of tools and without requiring that the axial spacing between head 98 and nut 100 to increase. Thus, assembly and disassembly of squeegee 10 or 10' can be accomplished by simply rotating head 98 through a maximum angle of 90° according to the most preferred teaching of the present invention.

It should be appreciated that head 98 of retainer 94 is located outwardly of machine 10 in the preferred embodiments shown according to the teachings of the present invention. Specifically, head 98 can be made as small as possible and can be shaped in a manner to minimize engaging with and/or catching on obstructions in the work area. Also, the exposure of head 98 to cleaning solutions is minimized as the intent of squeegee assembly 10 and 10' is to prevent cleaning solution from passing therebeyond.

It should be appreciated that locating pins 50 of the preferred form of the present invention are advantageous for several reasons. First, pins 50 are advantageous in assembly and holding wiper blade 30 and retaining strap 34 or 34' in position while retainers 94 are moved between their first and second positions. Furthermore, pins 50 keep wiper blade 30 from sliding between bracket 32 or 32' and retaining strap 34 or 34' according to the teachings of the present invention to minimize the number of retainers 94 required.

Slots 46 according to the teachings of the present invention are advantageous in preventing dislodgment of squeegee assembly 10 or 10' from machine 12. In particular, slots 46 are arranged such that in normal operation of machine 12, forces on squeegee assembly 10 or 10' do not tend to result in their movement relative to machine 12 such that bolts 56 located in legs 46*b* will move into or from legs 46*a*. This tendency is further enhanced by protrusions 46*c*. In installing of squeegee assembly 32 of the preferred form shown, bolt 56 is first aligned with slot 46 of tab 44 and moved into leg 46*a* thereof. Bracket 32 is then pivoted about bolt 56 in tab 44 and simultaneously slid to move bolt 56 into tab 42 and into legs 46*b*. Bracket 32' can be moved parallel and then perpendicular to machine 12 to put bolts 56 into slots 46. Even if knob 58 is not tightened and/or becomes loose as a result of operation of machine 12, squeegee assembly 10 or 10' according to the teachings of the present invention will not tend to be dislodged from machine 12.

Now that the basic teachings of the present invention have been explained, many extensions and variations will be obvious to one having ordinary skill in the art. For example, although several independent and inventive aspects have been incorporated into a single embodiment of squeegee assemblies 10 and 10' according to the most preferred form, a squeegee assembly including one or more of such inventive aspects in different combinations can be designed by a person skilled in the art. As examples, retainer 94 according to the teachings of the present invention could be utilized with other types and forms of retaining elements. Likewise, retaining elements including arcuate portions and/or bent edges defining a plane spaced from a center section according to the teachings of the present invention could be retained in different manners. Likewise, L-shaped slots for securing to a machine could be utilized in other types and forms of squeegee assemblies according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A squeegee assembly comprising, in combination: a flexible wiper blade; a first retaining element; a second retaining element, with the flexible wiper blade sandwiched between the first and second retaining elements; and at least a first retainer, with the retainer including a shaft extending from the first retaining element and having an axis, with the retainer further including a head connected to the shaft and axially spaced from the first retaining element, with the shaft having cross sections perpendicular to the axis of the shaft, with the head having cross sections perpendicular to the axis of the shaft different than the cross sections of the shaft and having different radial extents than the cross sections of the shaft, with the flexible wiper blade including a mounting aperture having cross sections corresponding to and for slideable passage of the cross sections of the head, with the second retaining element having an upper edge, a lower edge and a center section, with the upper and lower edges being formed on a bent section having linear configuration, bent at an obtuse angle relative to the center section, the upper and lower edges abutting with the flexible wiper blade sandwiched between the first and second retaining elements and defining an abutment plane, with the center section having a linear configuration and being spaced from the abutment plane and from the flexible wiper blade, and the second retaining element including a mounting aperture formed in the center section and having cross sections corresponding to and for slideable passage of the cross sections of the head, with the mounting apertures of the flexible wiper blade and the second retaining element being aligned when the flexible wiper blade is sandwiched between the first and second retaining elements, with the shaft extending through the aligned mounting apertures, with the head being positionable relative to the second retaining element between a first position and a second position, with the head in the first position being aligned with the aligned mounting apertures allowing passage of the head through the aligned mounting apertures, with the head in the second position being misaligned with the aligned mounting apertures and abutting with the second retaining element around the mounting aperture of the second retaining element.

2. The squeegee assembly of claim 1 further comprising, in combination: a locating pin, with the locating pin extending from one of the first and second retaining elements, with locating apertures formed in the flexible wiper blade and the other of the first and second retaining elements for slideably receiving the locating pin.

3. The squeegee assembly of claim 2 with the head being semicylindrical in shape and having an axially extending flat surface, with the shaft extending generally perpendicular to the axially extending flat surface.

4. The squeegee assembly of claim 3 with the first retaining element including a mounting bore, with the shaft rotatably received in the mounting bore, with the head being movable between the first and second positions by rotation of the shaft in the mounting bore.

5. The squeegee assembly of claim 4 with the shaft being threaded, and with the retainer further including a nut threadably received on the shaft, with the nut located on the opposite side of the first retaining element than the second retaining element, with the nut being T-shaped.

6. A squeegee assembly comprising, in combination: a flexible wiper blade; a first retaining element; a second retaining element, with the flexible wiper blade sandwiched between the first and second retaining elements; and at least a first retainer, with the retainer including a shaft extending from the first retaining element and having an axis, with the retainer further including a head connected to the shaft and axially spaced from the first retaining element, with the shaft having cross sections perpendicular to the axis of the shaft, with the head having cross sections perpendicular to the axis of the shaft different than the cross sections of the shaft and having different radial extents than the cross sections of the shaft, with the flexible wiper blade including a mounting aperture having cross sections corresponding to and for slideable passage of the cross sections of the head, with the first retaining element including first and second, spaced, L-shaped slots for slidably receiving a bolt carried by the machine, with each of the first and second L-shaped slots including a first leg and a second leg extending generally perpendicularly from the first leg at an interconnection, with the second leg including a protrusion into the L-shaped slot at the interconnection, with the second retaining element including a mounting aperture having cross sections corresponding to and for slideable passage of the cross sections of the head, with the mounting apertures of the flexible wiper blade and the second retaining element being aligned when the flexible wiper blade is sandwiched between the first and second retaining elements, with the shaft extending through the aligned mounting apertures, with the head being positionable relative to the second retaining element between a first position and a second position, with the head in the first position being aligned with the aligned mounting apertures allowing passage of the head through the aligned mounting apertures, with the head in the second position being misaligned with the aligned mounting apertures and abutting with the second retaining element around the mounting aperture of the second retaining element.

7. The squeegee assembly of claim 1 wherein each of the first and second retaining elements includes a leading end, a trailing end and an arcuate portion located intermediate the leading end and the trailing end, with the arcuate portions of the first and second retaining elements having unequal radiuses from a center, with the radius of the arcuate portion of the second retaining element being smaller than the radius of the arcuate portion of the first retaining element, with the first retaining element being intermediate the center and the second retaining element.

8. The squeegee assembly of claim 7 wherein each of the first and second retaining elements includes first and second linearly straight portions, with the first linearly straight portion extending from the leading end to the arcuate portion and the second portion extending from the trailing end to the arcuate portion.

9. The squeegee assembly of claim 8 wherein each of the first and second linearly straight portions of the second retaining element includes a free upper edge, a free lower edge and a center section, with the free upper and lower edges abutting with the flexible wiper blade sandwiched between the first and second retaining elements and defining an abutment plane, with the center section being spaced from the abutment plane and from the flexible wiper blade, with the mounting apertures formed in the center section.

10. The squeegee assembly of claim 8 wherein the arcuate portions of the first and second retaining elements have radiuses of 5% difference or less.

11. The squeegee assembly of claim 8 wherein the first retaining element comprises a mounting bracket removably attachable to a machine.

12. The squeegee assembly of claim 11 wherein the first retaining element includes first and second, spaced, L-shaped slots for slidably receiving a bolt carried by the machine.

13. The squeegee assembly of claim 8 wherein the second retaining element comprises a mounting bracket removably attachable to a machine.

14. The squeegee assembly of claim 1 with the head being semicylindrical in shape and having an axially extending flat surface, with the shaft extending generally perpendicular to the axially extending flat surface.

* * * * *

UNITED STATES PATENT AND TRADEMARK OFFICE

CERTIFICATE OF CORRECTION

PATENT NO. : 8,166,606 B2
APPLICATION NO. : 12/295383
DATED : May 1, 2012
INVENTOR(S) : Kale R. Johnson et al.

It is certified that error appears in the above-identified patent and that said Letters Patent is hereby corrected as shown below:

Title page, before item (51) Int. Cl., insert
-- Related U.S. Application Data
(60) Provisional application No. 60/765,973, filed on Feb. 7, 2006 --.

Signed and Sealed this
Eighteenth Day of December, 2012

David J. Kappos

David J. Kappos
*Director of the United States Patent and Trademark Office*